US011944244B2

(12) United States Patent
Akinleye

(10) Patent No.: US 11,944,244 B2
(45) Date of Patent: Apr. 2, 2024

(54) SPINE-SUPPORTING PAD WITH ADJUSTABLE AUDIO-VISUAL DEVICE MOUNT

(71) Applicant: Olufisayo Akinleye, Bowie, MD (US)

(72) Inventor: Olufisayo Akinleye, Bowie, MD (US)

( * ) Notice: Subject to any disclaimer, the term of this patent is extended or adjusted under 35 U.S.C. 154(b) by 0 days.

(21) Appl. No.: 17/682,941

(22) Filed: Feb. 28, 2022

(65) Prior Publication Data

US 2022/0287513 A1 Sep. 15, 2022

Related U.S. Application Data

(60) Provisional application No. 63/154,631, filed on Feb. 26, 2021.

(51) Int. Cl.
*A47K 3/12* (2006.01)

(52) U.S. Cl.
CPC ..... *A47K 3/127* (2013.01)

(58) Field of Classification Search
CPC ..... A47K 3/127
USPC ..... 4/572.1
See application file for complete search history.

(56) References Cited

U.S. PATENT DOCUMENTS 2,460,308 A * 2/1949 Pribil ..... A47D 15/008 5/655
4,766,620 A * 8/1988 Boyhan ..... A45D 19/00 4/519
5,548,853 A * 8/1996 Johnson ..... A45D 19/10 4/523
D386,318 S * 11/1997 Smith ..... D6/333

* cited by examiner

*Primary Examiner* — Huyen D Le
(74) *Attorney, Agent, or Firm* — Law Office of Jerry Joseph; Jerry Joseph

(57) ABSTRACT

Exemplary arrangements include an apparatus for baby care comprising a base that includes an upper surface and a mat that extends in operative connection therewith. The mat portion includes a receiving portion for comfortable receipt of a baby thereon. The exemplary apparatus further comprises an adjustable strap that is operatively connected to opposing sides of the base and that extends across the receiving portion to comfortably secure a baby. The exemplary apparatus further comprises a flexible arm that includes proximal and distal ends. The proximal end is in operative connection with the base and the distal end is disposed above the receiving portion. The distal end includes an adjustable audio-visual device mount in operative connection therewith that is configured to operatively releasably engage an audio-visual device. In alternative exemplary arrangements, the exemplary apparatus is configured to be changeable between a open position and a folded position for storage and travel.

20 Claims, 15 Drawing Sheets

SPINE-SUPPORTING PAD WITH ADJUSTABLE AUDIO-VISUAL DEVICE MOUNT

FIELD OF INVENTION

The exemplary arrangements relate to a spine-supporting pad or bathmat having an adjustable audio-visual device mount.

BACKGROUND

Commercial bathmats for babies are typically flat, do not provide an adjustable audio-visual mount, are not foldable, and are not adjustable to accommodate different heights of a baby as the baby grows.

Therefore, what is desired is an exemplary arrangement of a spine supporting mat for comfortably receiving a baby thereon and including an adjustable audio-visual device mount. What is further desired is an exemplary arrangement of a spine supporting mat for comfortably receiving a baby thereon, including an adjustable audio-visual device mount, and being foldable for storage and travel.

SUMMARY OF THE INVENTION

Certain of the foregoing and related aspects are readily attained according to the present general inventive concept by providing an apparatus for baby care including a base, wherein the base extends generally horizontally and includes an upper surface, a mat portion, wherein the mat portion is operatively connected to the base upper surface, extends generally horizontally, parallel to the base, and includes a head portion, a foot portion, and an upper receiving portion, wherein the upper receiving portion extends intermediate of the head portion and the foot portion and is configured to receive a baby thereon, at least one adjustable strap, wherein the at least one adjustable strap includes a first strap end and second strap end wherein the first strap end is operatively connected to at least one of the base and the mat portion, and wherein the second strap end is operatively connected to an opposing side of the one of the base and the mat portion such that the at least one strap extends transversely across the receiving portion intermediate of the head portion and the foot portion, and wherein the at least one strap is configured to adjustably secure a baby in an operative position on the receiving portion, a flexible arm, wherein the flexible arm includes a proximal end and a distal end, wherein the proximal end is in operative connection with the base, and wherein the distal end is disposed from the proximal end and extends above the receiving portion, an adjustable device mount, wherein the adjustable device mount is in operative connection with the distal end of the flexible arm, and is configured to operatively releasably engage an audio-visual device.

The at least one strap may include an adjustable fastener, wherein the adjustable fastener is operatively configured to adjust a size of the strap to comfortably secure a baby on the receiving portion.

The at least one strap may include a plurality of straps, wherein the respective first strap end of each of the plurality of straps is operatively connected to at least one of the base and the mat, and wherein the respective second strap end of each of the plurality of straps is operatively connected to the opposing side of the one of the base and mat portion such that each of the plurality of straps extends transversely across the receiving portion.

The base may include a plurality of arm receiving points disposed in surrounding relation of the receiving portion, wherein the proximal end of the flexible arm is operatively configured to be detachable from the base, and wherein the proximal end of the flexible arm is operatively engageable with each of the arm receiving points to maintain the distal end disposed above the receiving portion.

The mat portion is made of a material, wherein the material may be deformable.

The mat portion may include an oblong shape having a width that comfortably accommodates a baby.

At least one of the mat portion and the base may include a head rest, whereby when a baby is operatively positioned on the receiving portion, a head of the baby is propped upward to view an audio-visual device engaged with the adjustable device mount.

Wherein the adjustable fastener may include one of a buckle, a clasp, a portion of hook and a portion of loop, and a plurality of disposed pairs of magnets.

Wherein at least one strap and the adjustable fastener may include padding in operative connection therewith, wherein the padding is configured to protect the skin of the baby when the strap is adjusted to secure the baby on the receiving portion.

Wherein the base may include a first portion and a second portion, wherein the first portion and the second portion each include a portion of the base upper surface and are operatively movably connected by at least one hinge, wherein the base is movable between a folded position and an open position, wherein in the folded position, the respective upper surface of each of the first portion and the second portion are in facing relation, and wherein in the open position, the respective upper surface of each of the first portion and the second portion extend continuously in a generally horizontal plane.

Wherein the base folded position, the mat portion may be in a folded condition disposed between the respective upper surface of the first portion and the second portion, wherein in the mat folded condition, the head portion is immediately adjacent to the foot portion.

Certain of the foregoing and related aspects are readily attained according to the present general inventive concept by also providing an apparatus for baby care, including a base, wherein the base comprises a first portion and a second portion, wherein the first portion and the second portion are operatively movably connected by at least one hinge, wherein each of the first portion and the second portion include a respective upper surface, a deformable mat portion, wherein the deformable mat portion is operatively connected to at least one of the first base portion and the second base portion and extends across the upper surfaces thereof, and includes a head portion, a foot portion, and an upper receiving portion, wherein the upper receiving portion extends intermediate of the head portion and the foot portion and is configured to receive a baby thereon, wherein the base is movable between a folded position and an open position, wherein in the base folded position, the respective upper surface of each of the first portion and the second portion are in facing relation, and the mat portion is in a folded condition disposed between the upper surfaces of the first and second portion, and wherein in the mat folded condition the head portion is immediately adjacent the foot portion, wherein in the base open position, the respective upper surface of each of the first portion and the second portion extend continuously in a generally horizontal plane, and the mat portion is in a use condition, wherein in the use condition, the mat portion extends parallel to the generally horizontal plane in which the respective upper surfaces of the first and second portions extend, at least one adjustable strap, wherein the at least one adjustable strap is operatively connected to opposing sides of at least one of the first or second base portions, and wherein in the base open position and the mat use condition, the at least one adjustable strap extends transversely across the receiving portion intermediate of the head portion and the foot portion, and is configured to adjustably secure a baby in an operative position on the receiving portion, a flexible arm, wherein the flexible arm includes a proximal end and a distal end, wherein the proximal end is in operative connection with one of the first or second base portions, and wherein the distal end is disposed from the proximal end, wherein in the base open position, the distal end extends above the receiving portion, an adjustable device mount, wherein the adjustable device is in operative connection with the distal end of the flexible arm, and is configured to operatively releasably engage an audio-visual device.

Certain of the foregoing and related aspects are readily attained according to the present general inventive concept by also providing an apparatus for baby care including a base, wherein the base comprises a first portion and a second portion, wherein the first portion and the second portion are operatively movably connected, wherein each of the first portion and the second portion include a respective upper surface, wherein the respective upper surfaces each include a deformable mat portion, wherein the respective deformable mat portion of each of the first and second portion together comprise a receiving portion, wherein the receiving portion is configured to receive a baby thereon, wherein the base is movable between a folded position and an open position, wherein in the base folded position, the respective upper surface of each of the first portion and the second portion are in adjacent facing relation, and the respective mat portion of each of the first portion and the second portion is disposed between the respective upper surfaces of the first and second portion, wherein in the base open position, the respective upper surface of each of the first portion and the second portion extend continuously in a generally horizontal plane, and the respective mat portion of each of the first and second portion extends parallel to the generally horizontal plane in which the respective upper surfaces extend, at least one adjustable strap, wherein the at least one adjustable strap is operatively connected to opposing sides of the base, extends transversely across the receiving portion, and is configured to adjustably secure a baby in an operative position on the receiving portion, a flexible arm, wherein the flexible arm includes a proximal end and a distal end, wherein the proximal end is in operative connection with the base, and wherein the distal end is disposed from the proximal end and is configured to extend above the receiving portion when the base is in the open position, an adjustable device mount, wherein the adjustable device is in operative connection with the flexible arm and is configured to operatively releasably engage an audio-visual device.

DESCRIPTION OF INVENTION

The exemplary arrangements provide an exemplary apparatus and/or device and method of using an exemplary spine-supporting spa pad or bathmat including an exemplary adjustable audio-visual device mount.

The exemplary arrangements also provide an exemplary device, pad, and/or apparatus designed to help a caregiver wash a young child's hair by keeping the child entertained by using an audio-visual device that is detachably coupled to an adjustable audio-visual device mount. As a result, the caregiver can easily wash the young child's hair while the child focuses on the audio-visual device coupled to the adjustable audio-visual device mount.

The exemplary arrangements also provide a device, pad, and/or apparatus that promotes and maintains proper spinal support, alignment and proprioceptive feedback to the young child through the durable material of the device, pad, and/or apparatus according to exemplary arrangements.

Figure 1:
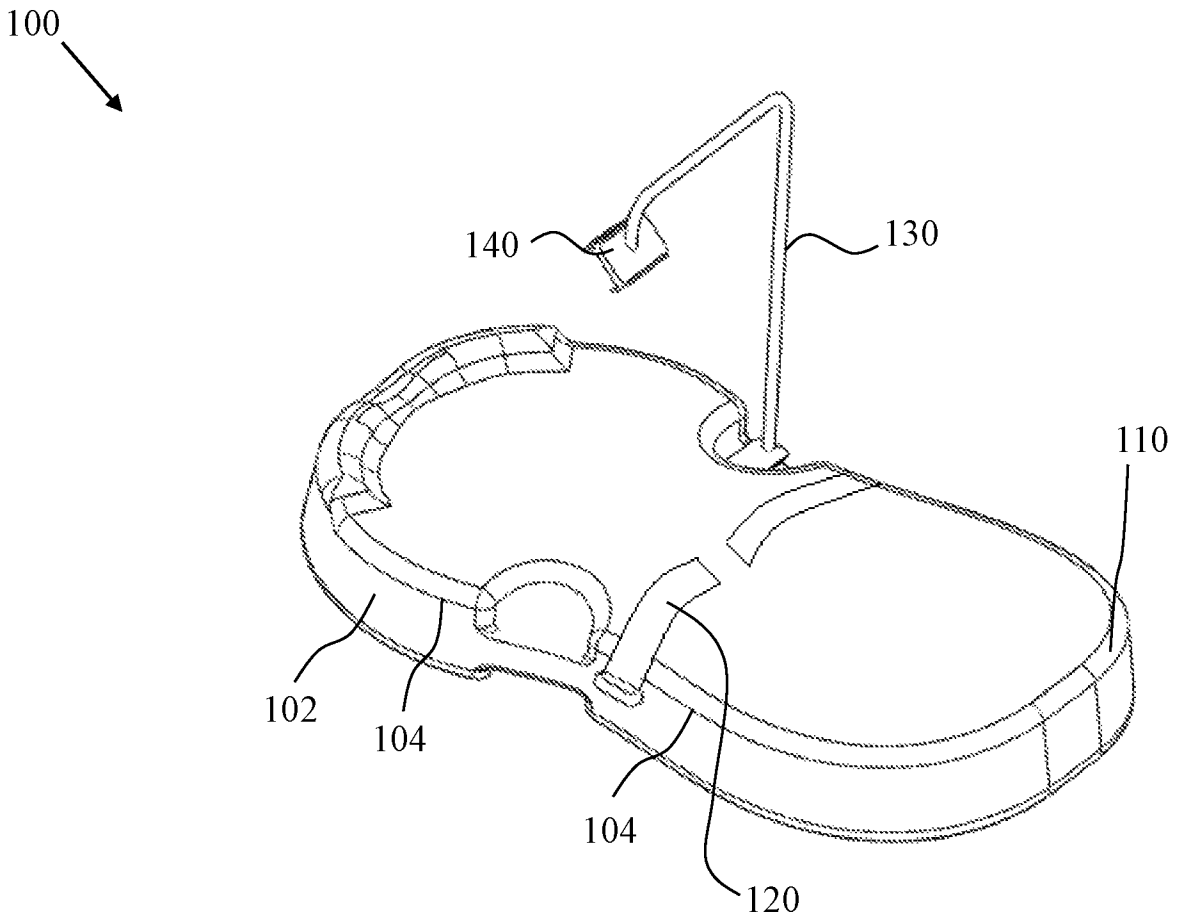
FIG. 1 is a right-perspective view of an exemplary spine-supporting bathmat with an exemplary adjustable audio-visual device mount.

FIG. 1 is a right-perspective view of an exemplary spine-supporting bathmat with an exemplary adjustable audio-visual device mount. The exemplary apparatus 100 includes a base 102, a mat portion 110, a cincture (e.g., a strap) 120, a flexible arm 130, and an audio-visual device mount 140. However, the present general inventive concept is not limited thereto.

In exemplary embodiments, the exemplary base 102 comprises a raised platform shaped to comfortably receive, support, and/or align the spine of a baby or small child. For example, the exemplary base 102 may include relatively concave or convex portions on an upper surface 104 thereof to support the general shape of a spine. The exemplary base 102 extends generally horizontally. As used here in, generally horizontally means plus or minus 15° from 0°. The exemplary upper surface 104 is configured to receive a baby thereon. However, the upper surface 104 is also configured to receive a mat portion or pad as will be discussed later, for providing further spinal support and comfortability. In the present embodiment, the base 02 is configured to be supported by a ground, a table or counter, or other raised surface, or to be operatively placed in a tub or on a shower floor. The upper surface 104 of the base 102 is disposed above the floor or raised surface and faces away from the floor or raised surface. Of course, this arrangement is merely exemplary, and in other embodiments, other arrangements may be used.

In exemplary arrangements, the exemplary mat portion 110 is operatively positioned on the upper surface 104 of the base 102. The exemplary mat portion 110 is operatively secured to the base portion 102 through any securing means. For example, the mat portion 110 may be secured to the base 102 through fusion, heat welding, adhesives, straps, strings, snaps, magnets, or any other means of securing the mat portion 110 to the base 102. However, this arrangement is merely exemplary, and in other embodiments, other arrangements may be used.

Figure 2:
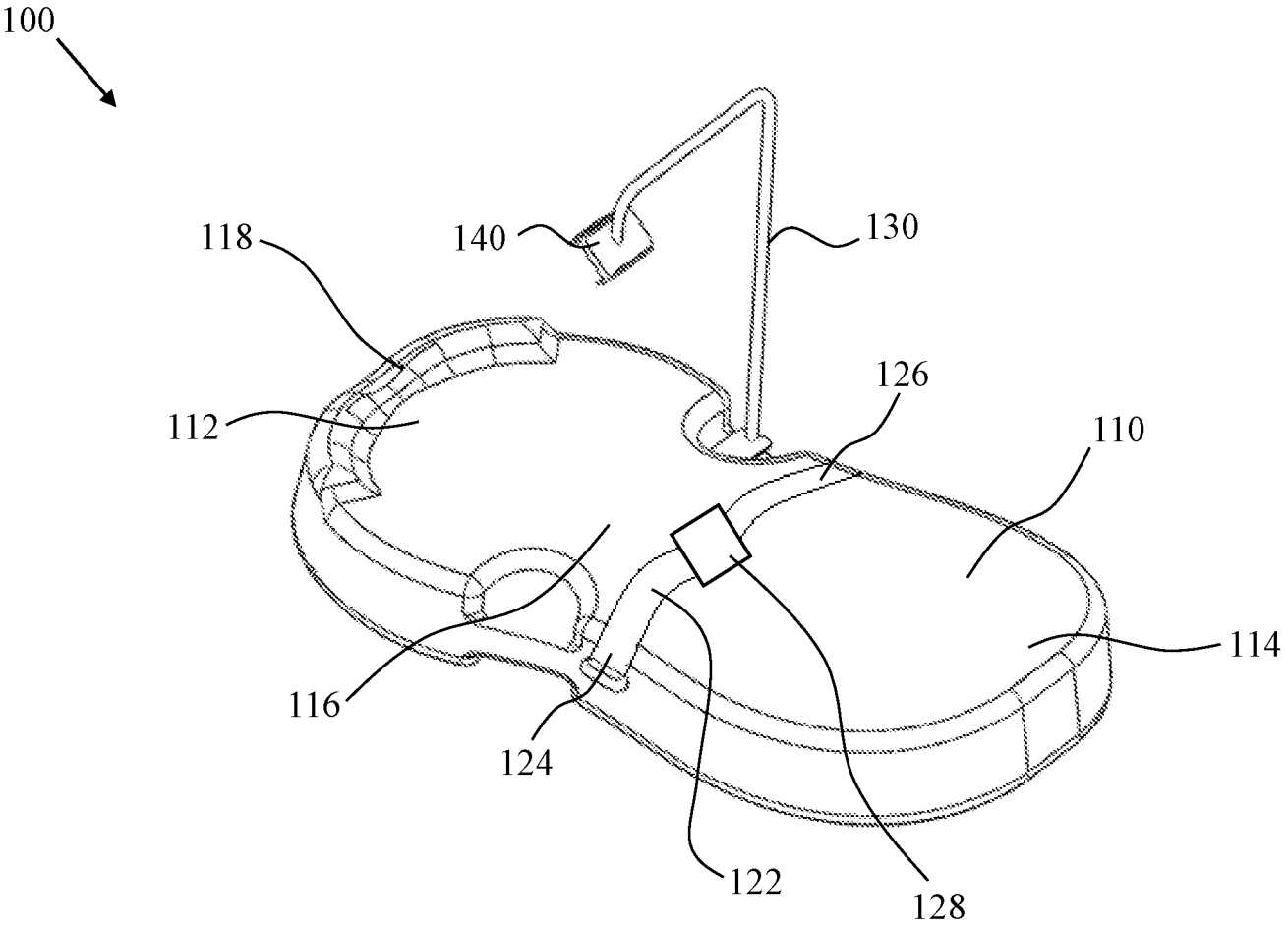
FIG. 2 is a right-perspective view of an exemplary spine-supporting bathmat with an exemplary adjustable audio-visual device mount.

FIG. 2 is a right-perspective view of an exemplary spine-supporting bathmat with an exemplary adjustable audio-visual device mount 140. The exemplary mat portion 110 extends generally horizontally and parallel to the base 102, above the upper surface 104 of the base 102, as shown in FIG. 2. In exemplary arrangements, the exemplary mat portion 110 includes a head portion 112, a foot portion 114, and an upper receiving portion 116. The exemplary receiving portion 116 extends along the upper surface 104 of the base 102 intermediate of the head portion 112 and the foot portion 114. The exemplary receiving portion 116 is configured to comfortably receive a baby thereon. In exemplary arrangements, a baby is operatively positioned on the receiving portion 116 such that the head of the baby is adjacent to the head portion 112 and the feet of the baby are adjacent the foot portion 114. The exemplary head portion 112 includes a headrest 118 that is configured to prop up the baby's head such that the baby is able to more easily view an audio-visual device engaged with the device mount 140.

In exemplary arrangements, the mat portion 110 is formed in an oblong shape having a length and width that comfortably accommodates a baby or small child. The exemplary mat portion 110 is comprised of a deformable material on which the baby is rested on its back so that the deformable material conforms to the baby's spine and supports the baby's spine while the baby lies on the mat portion 110. Of course, this arrangement of the mat portion is merely exemplary, and in other embodiments, other arrangements may be used.

In alternative exemplary arrangements, the apparatus 100 is configured to be placed in a bathtub or on a shower floor in order to give the baby a bath or clean. In such alternative exemplary arrangements, the exemplary apparatus 100 may be comprised of a waterproof material, a water wicking material, or a quick dry fiber or material. Additionally, the exemplary apparatus 100 may further include structures or properties that enable the apparatus 100 to quickly drain and dry at ambient temperature. Further, the exemplary apparatus 100 may be comprised of or include properties that are antimicrobial, such as antimicrobial plastics and fabrics or fibers, in order to prevent the buildup of bacteria or other organisms that may commonly be present in bathroom or changing area facilities. Still further, the exemplary apparatus 100 may include floats or other buoyant structures configured to cause the apparatus 100 to float in a tub, pool, lake, ocean or similar aquatic environment. In still other alternative exemplary arrangements, the exemplary apparatus 100 may also be used as a diaper-changing station, a daybed, or similar. However, these alternative arrangements are merely exemplary, and in other embodiments, other arrangements may be used.

In further alternative arrangements, as will be discussed later in greater detail, the exemplary apparatus 100 may be foldable for easy storage and adjustable to accommodate different heights of a baby, as the baby grows.

In exemplary arrangements, the mat portion 110 includes a cincture 120 for comfortably securing a baby to the mat portion 110. The exemplary cincture 120 may comprise one of a belt, a strap, or any other suitable cincture 120 that is configured to comfortably secure the baby to the mat portion 110. The exemplary cincture 120 is operatively adjustable such that cincture 120 can be adjusted between smaller and larger sizes. The exemplary cincture 120 is attached to the sides of the mat portion 110 at approximately the middle of the mat portion 110 so that the cincture comfortably secures the baby to the mat portion 110 around the waistline of the baby. As can be appreciated, this arrangement is merely exemplary, and in other embodiments, other arrangements may be used.

In some exemplary arrangements, as shown in FIG. 2, the cincture 120 comprises an adjustable strap 122. The exemplary adjustable strap 122 includes a first strap end 124 and a second strap end 126. The exemplary first end 124 is operatively connected to at least one of the base 102 and the mat portion 110. The exemplary second end 126 is operatively connected to an opposing side of the base 102 or the mat portion 110. For example, the exemplary straps 124 and 126 are operatively connected to the base 102 through a strap connection ring 125. In this configuration, the adjustable strap 122 extends transversely across the receiving portion 116 of the mat portion 110 at a point that is intermediate of the head portion 112 and the foot portion 114. As such, the adjustable strap 122 is configured to adjustably secure a baby in an operative position on the receiving portion 116. However, as can be appreciated, this arrangement is merely exemplary, and in other embodiments, other arrangements may be used.

The exemplary cincture 120 includes at least one adjustable fastener 128. The exemplary adjustable fastener 128 is operatively configured to adjust a size of the cincture 120 or strap 122 to comfortably secure a baby on the receiving portion 116. In exemplary arrangements, the exemplary adjustable fastener 128 comprises one of a buckle, a clasp, a portion of hook and a portion of loop (Velcro®), and a plurality of disposed pairs of magnets. Of course, this arrangement is merely exemplary, and in other embodiments, other arrangements may be used.

In alternative exemplary arrangements, the exemplary cincture 120 is moveable to accommodate different heights of the baby as the baby grows so that the cincture 120 is always located at a position so that the baby is secured around the waistline. For example, the exemplary base 102 may include a plurality of strap connection rings 125 at different positions along the length of the base 102 so that a user may select the proper position of the cincture 120 or strap 122 for securing their baby. In still other alternative exemplary arrangements, a plurality of cinctures 120 may be used to secure the baby. Each of the plurality of cinctures 120 may be positioned to secure the baby at a plurality of locations (e.g., around the head, under the arms, around the chest, around the legs, etc.). For example, a plurality of straps 122 may be used to secure the baby to the receiving portion 116. Each of the plurality of straps 122 are identical to the strap 122. As can be appreciated, these alternative arrangements are merely exemplary, and in other embodiments, other arrangements may be used.

Figure 3:
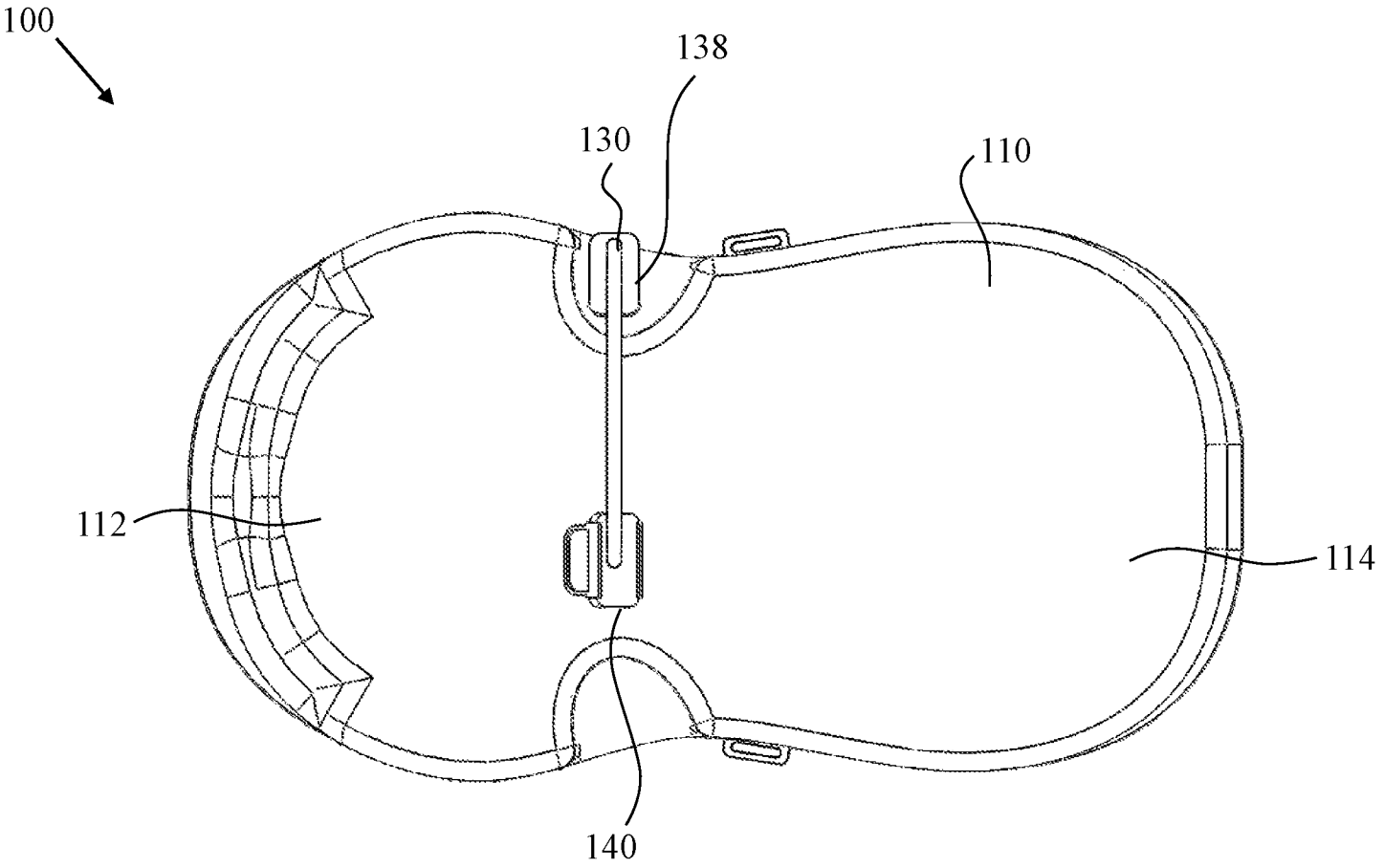
FIG. 3 is a top plan view of an exemplary spine-supporting bathmat with an exemplary adjustable audio-visual device mount.
Figure 4:
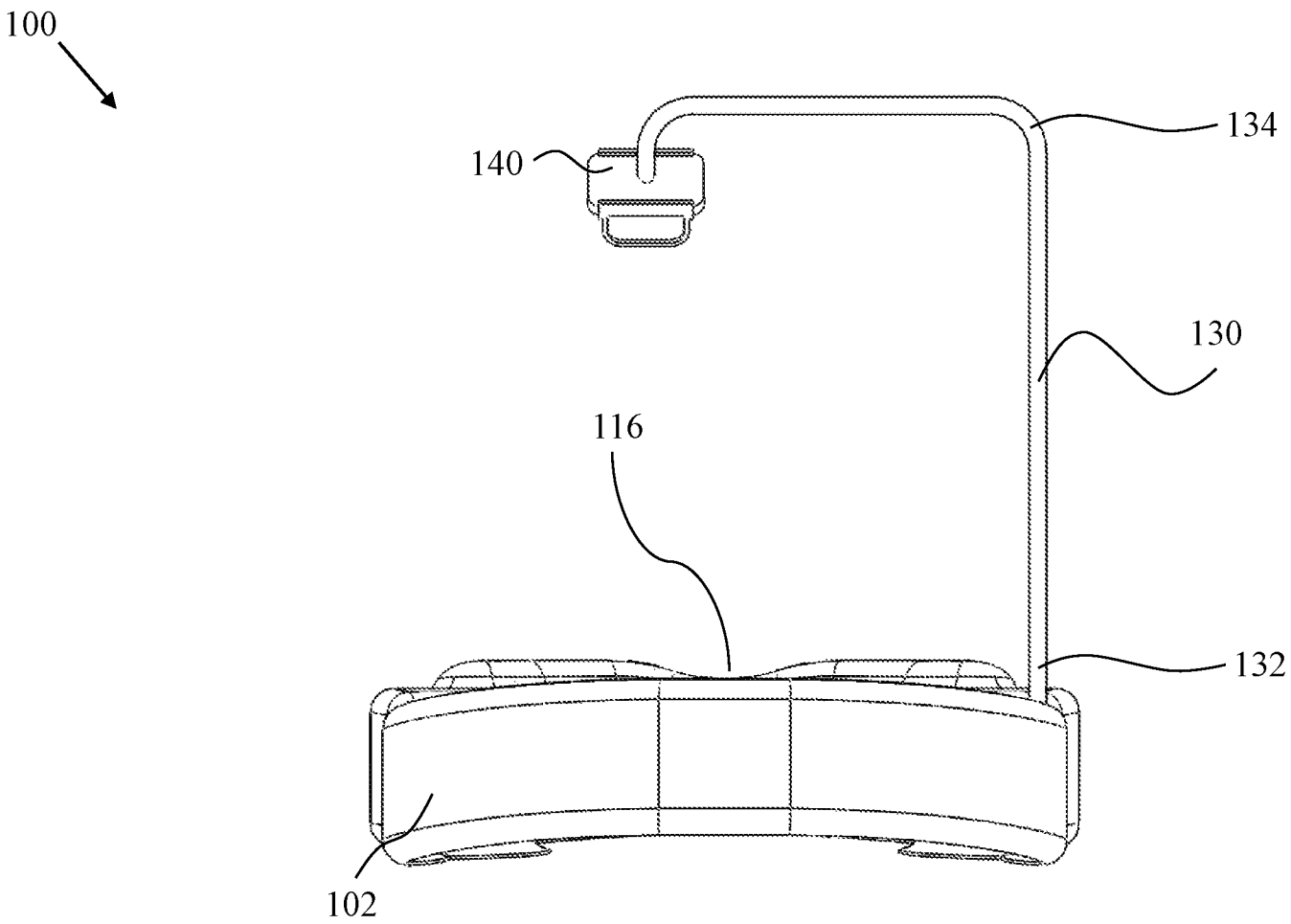
FIG. 4 is a left-side view of an exemplary spine-supporting bathmat with an exemplary adjustable audio-visual device mount.
Figure 5:
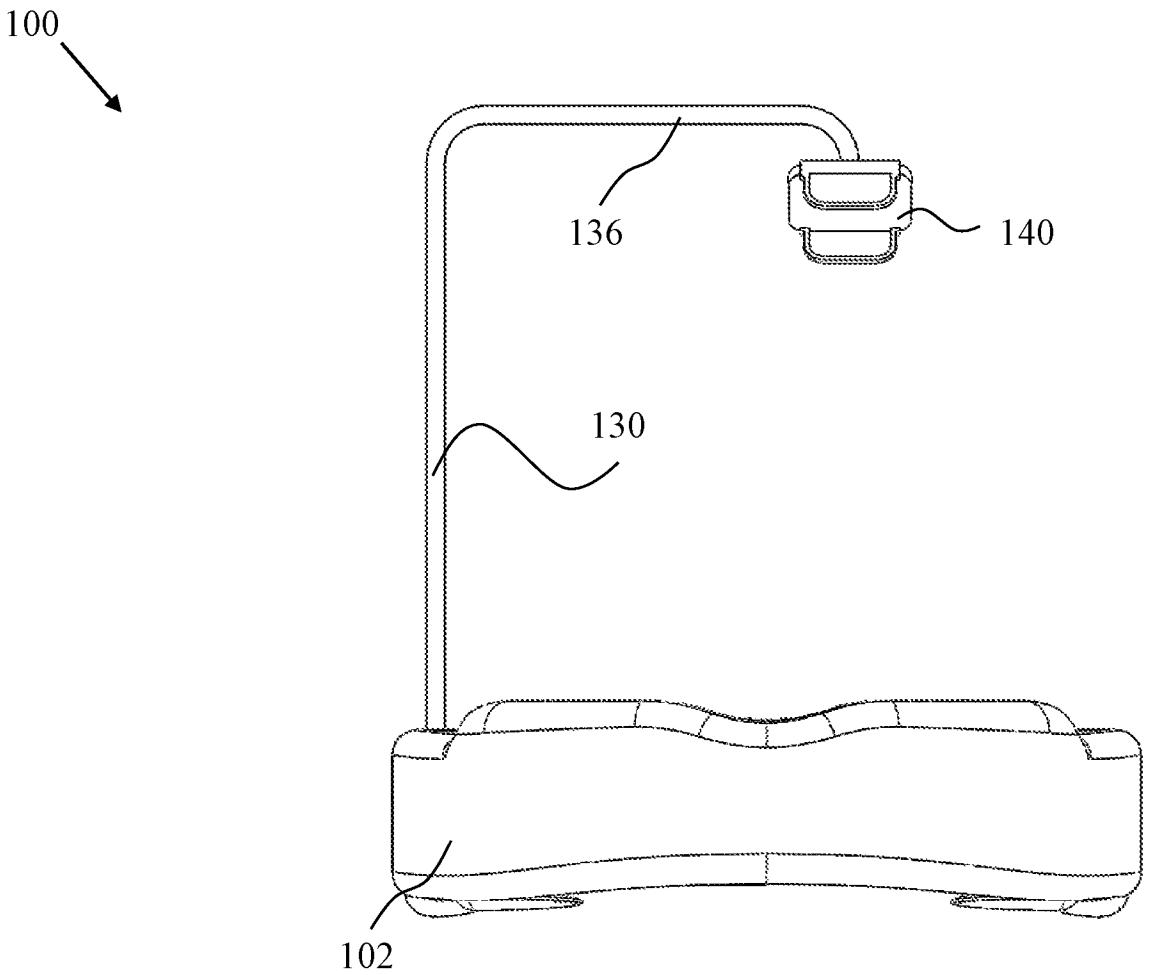
FIG. 5 is a right-side view of an exemplary spine-supporting bathmat with an exemplary adjustable audio-visual device mount.
Figure 6:
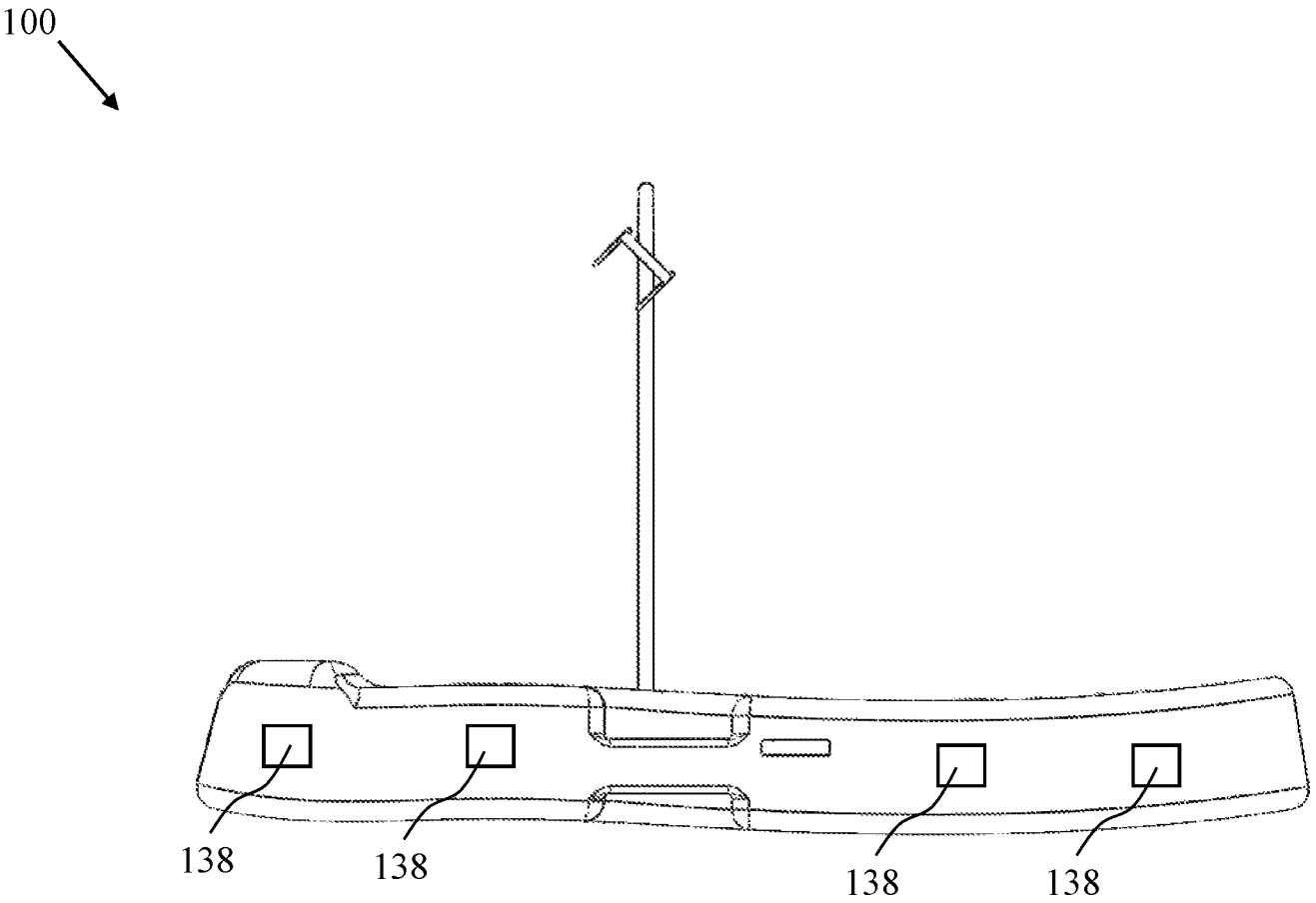
FIG. 6 is a front view of an exemplary spine-supporting bathmat with an exemplary adjustable audio-visual device mount.
Figure 7:
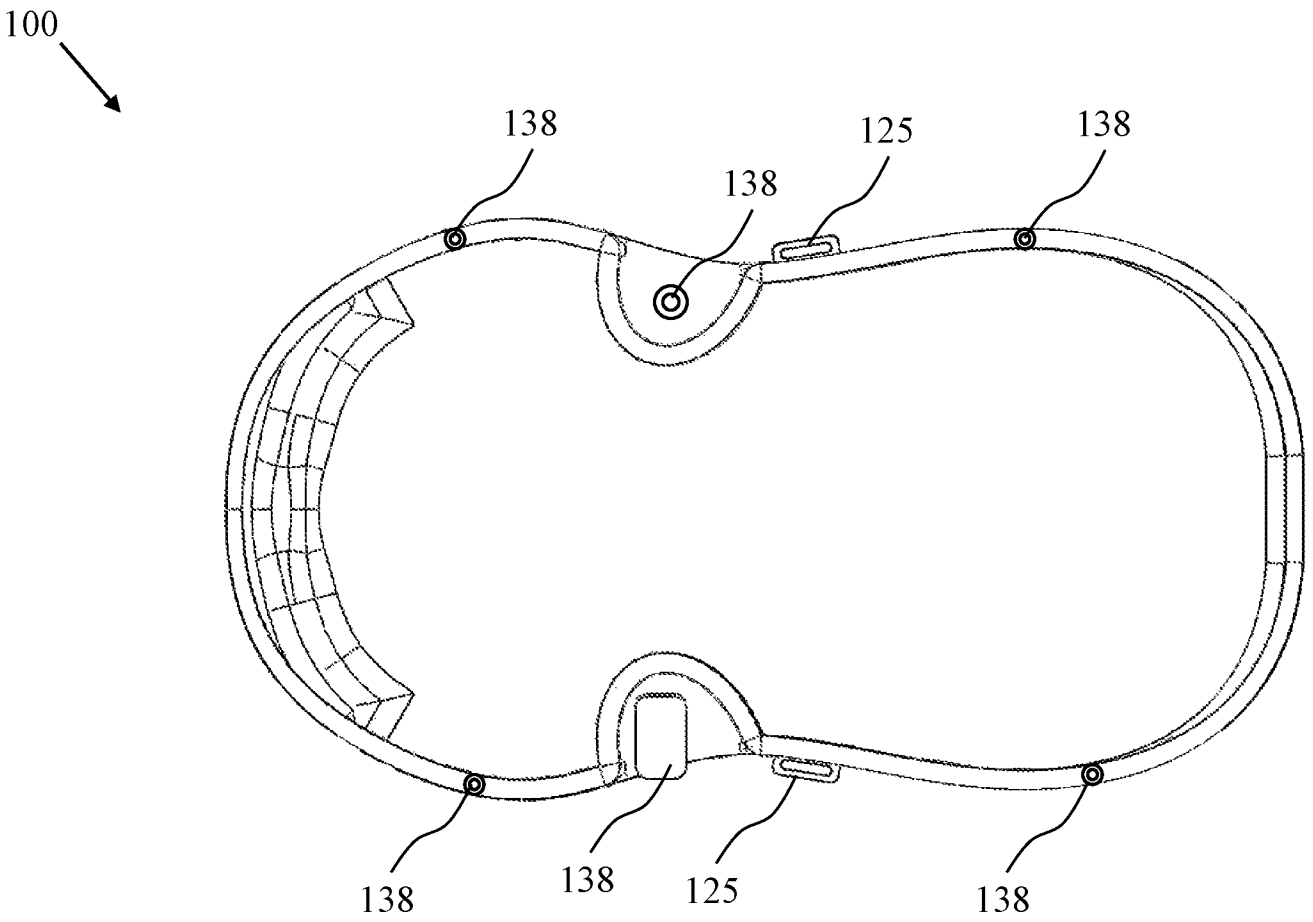
FIG. 7 is a bottom plan view of an exemplary spine-supporting bathmat with an exemplary adjustable audio-visual device mount.

FIG. 3 is a top plan view of an exemplary spine-supporting bathmat with an exemplary adjustable audio-visual device mount. FIG. 4 is a left-side view of an exemplary spine-supporting bathmat with an exemplary adjustable audio-visual device mount. FIG. 5 is a right-side view of an exemplary spine-supporting bathmat with an exemplary adjustable audio-visual device mount. FIG. 6 is a front view of an exemplary spine-supporting bathmat with an exemplary adjustable audio-visual device mount. FIG. 7 is a bottom plan view of an exemplary spine-supporting bathmat with an exemplary adjustable audio-visual device mount.

Now referring to FIGS. 3-4, in exemplary arrangements, the exemplary flexible arm 130 includes a proximal end 132 and a distal end 134. The exemplary proximal end 132 of the flexible arm 130 is operatively attached to one side of the mat portion 100 or the base 102. For example, the exemplary proximal end 132 of the flexible arm 130 is operatively connected to the mat portion 110 or base 102 intermediate of the head portion 112 and the foot portion 114. The exemplary distal end 134 of the flexible arm 130 includes an adjustable audio-visual device mount 140 in operative connection therewith.

In some exemplary arrangements, the proximal end 132 of the flexible arm 130 is in operative connection with the base 102. The exemplary distal end 134 is disposed from the proximal end 132. The exemplary distal end 134 is configured to extend above the receiving portion 116 such that any audio-visual device engaged with the mount 140 is in an operative viewing position above the receiving portion 116. Of course, this arrangement is merely exemplary, and in other embodiments, other arrangements may be used.

In alternative exemplary arrangements, as shown in FIG. 5, the distal end 134 of the flexible arm 130 includes an adjustable extension 136. The exemplary adjustable audio-visual device mount 140 is in operative connection with the extension 136. The exemplary extension 136 may comprise a telescoping arm that allows a user to further adjust the position of the mount 140 for better viewing of the audio-visual device engaged with the mount 140. The exemplary extension 136 extends generally perpendicular to the flexible arm 130, and generally parallel to the mat portion 110.

In still other alternative exemplary arrangements, the flexible arm 130 is detachable and locatable at different locations on the mat portion 110. The plurality of different positions of the flexible arm 130 enables various angles between the audio-visual device coupled to the adjustable audio-visual device mount 140.

In such alternative exemplary arrangements, the base 102 includes a plurality of arm receiving points 138, as shown in FIGS. 6-7. The exemplary arm receiving points 138 are disposed in surrounding relation of the receiving portion 116. In exemplary arrangements, the proximal end 134 of the flexible arm 130 is operatively engageable with each of the arm receiving points 138 to maintain the distal end 134 disposed above the receiving portion 116 for viewing of an audio-visual device engaged with the mount 140. The exemplary receiving points 138 may comprise one of an arm receiving aperture or opening, an elongated arm receiving slot, and a pair of magnets operatively connected to the flexible arm 130 and the base 102. However, these arrangements are merely exemplary, and in other embodiments, other arrangements may be used.

In exemplary arrangements, the exemplary audio-visual device may be detachably coupled or engaged to the adjustable audio-visual device mount 140. The exemplary device mount 140 is in operative connection with the distal end 134 of the flexible arm 130 to provide audio and/or video to the baby while lying on the mat portion 110. The exemplary audio-visual device may comprise a smart phone, smart tablet or pad, a cellphone, a lap-top computer, or any other suitable audio-visual device.

Figure 8:
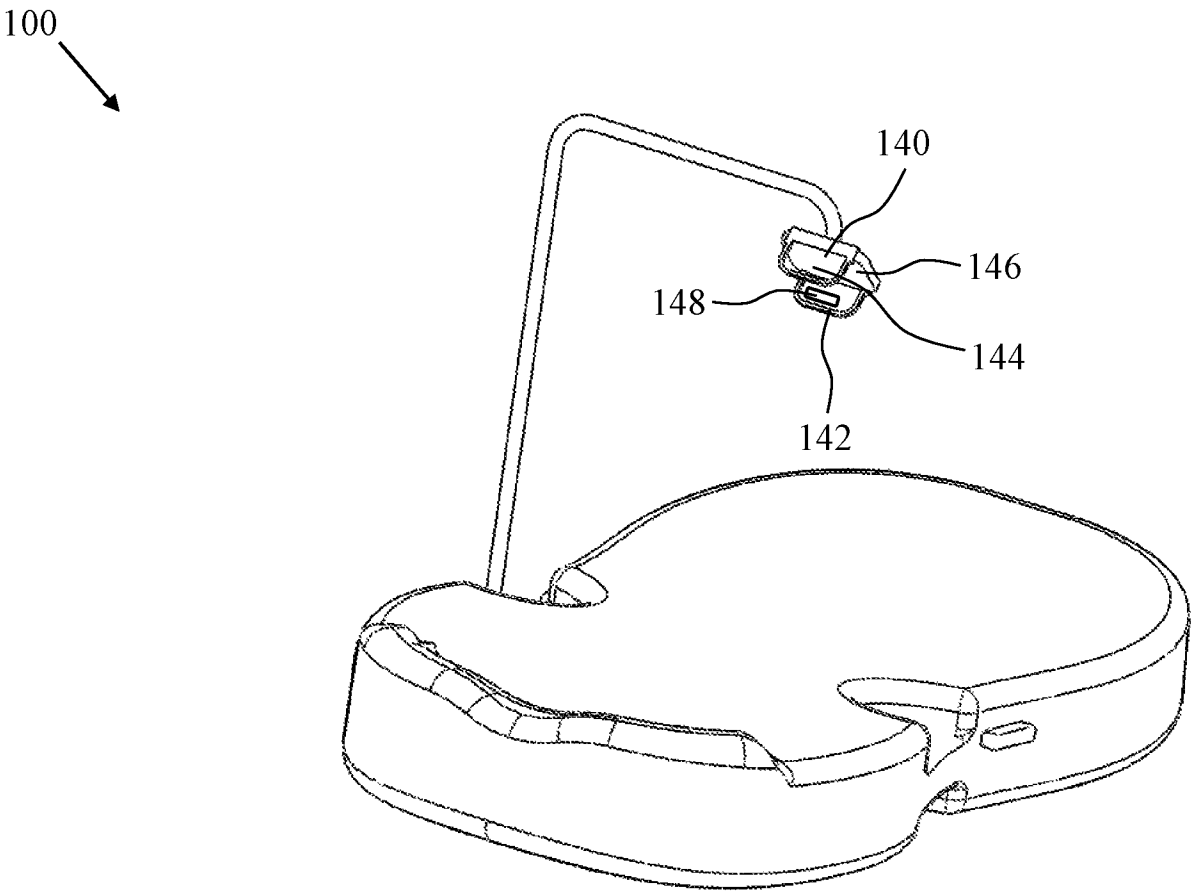
FIG. 8 is a top-left perspective view of an exemplary spine-supporting bathmat with an exemplary adjustable audio-visual device mount.
Figure 9:
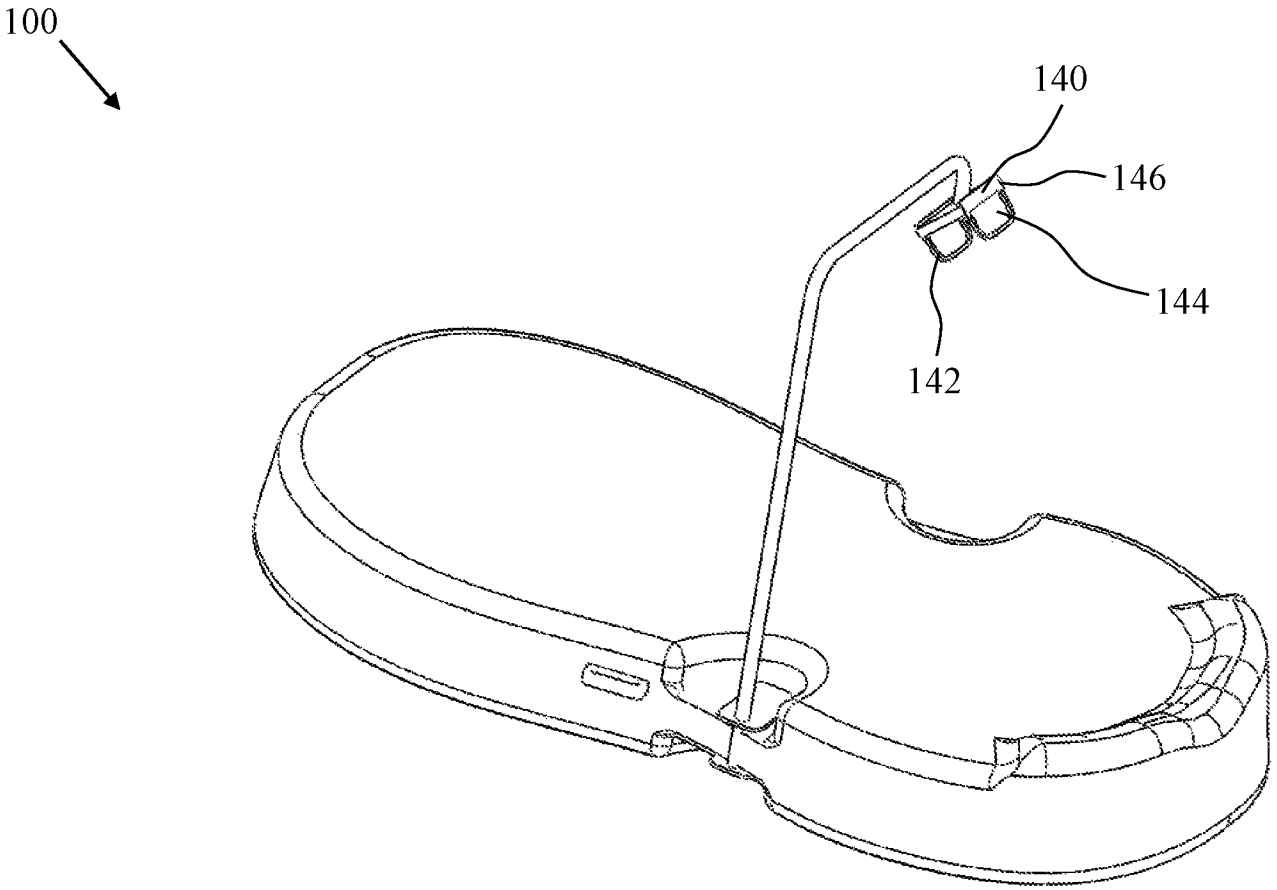
FIG. 9 is a top-right-perspective view of an exemplary spine-supporting bathmat with an exemplary adjustable audio-visual device mount.
Figure 10:
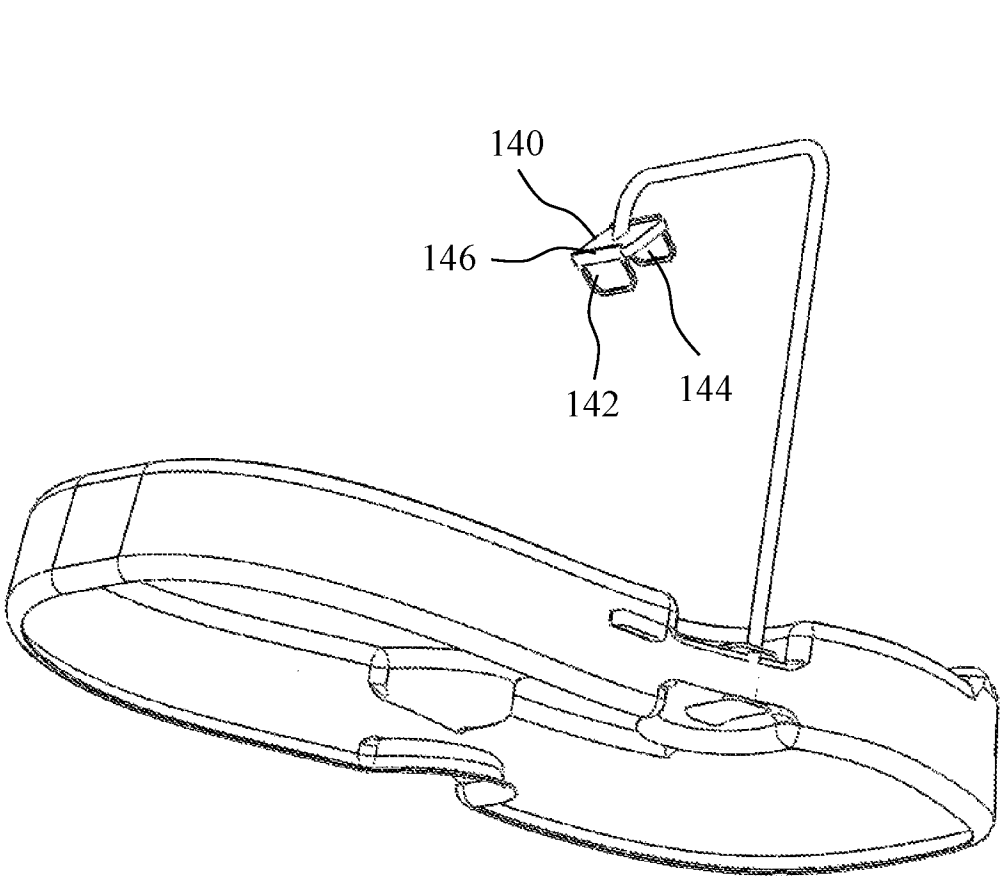
FIG. 10 is a bottom-left perspective view of an exemplary spine-supporting bathmat with an exemplary adjustable audio-visual device mount.

As shown in FIGS. 8-10, the exemplary device mound 140 comprises an adjustable bracket like structure. The exemplary device 140 includes a bottom platform 142, a top platform 144 and a backing 146. The exemplary bottom platform 142 and the exemplary top platform 144 extend generally perpendicular to the backing 146. In exemplary arrangements, an audio-visual device, for example a smart phone, is rested against the backing 146 between the bottom platform 142 and the top platform 144. In exemplary arrangements, the bottom platform 142 and the top platform 144 are movable relative to the backing 146 to be disposed further apart and closer together to accommodate audio-visual devices of different sizes. For example, the backing 146 may include a sleeve in which a perpendicular extension of the each of the platforms 142 and 144 is received. The perpendicular extensions of the platforms 142 and 144 may be moved into and out of the sleeve of backing 146 to cause the platforms 142 and 144 to be moved further apart or closer together. Of course, this arrangement is merely exemplary, and in other embodiments, other arrangements may be used.

When the exemplary audio-visual device is rested against the backing 146, the top platform 144 and bottom platform 142 are moved toward each other until the platforms 142 and 144 are in contacting relation with the upper and lower edges of the audio-visual device. The exemplary platforms 142 and 144 include elongated projections 148 to maintain the audio-visual device in its position rested against the backing 146. As can be appreciated, this arrangement is merely exemplary, and in other embodiments, other arrangements may be used.

Figure 11:
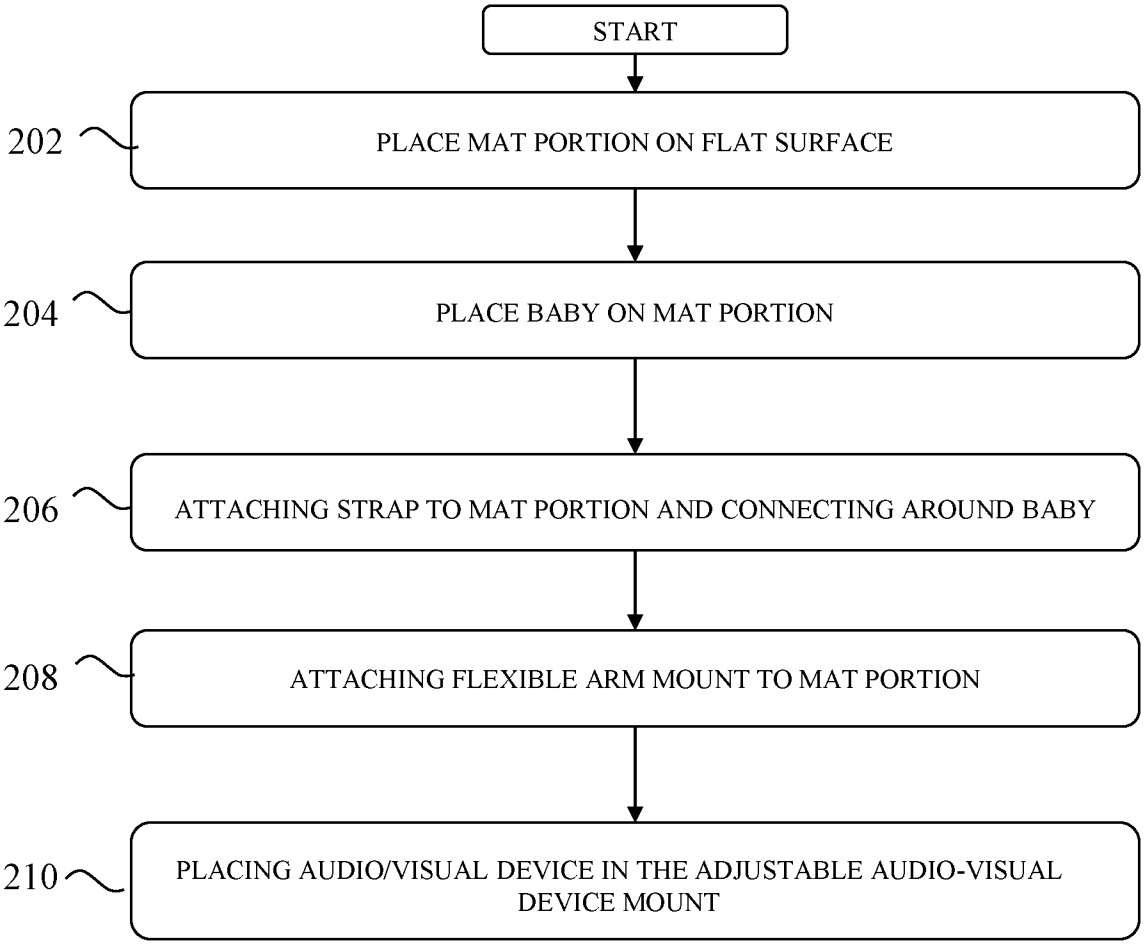
FIG. 11 is a flowchart of an exemplary method of using an exemplary spine-supporting pad or bathmat with an exemplary adjustable audio-visual device mount.

FIG. 11 is a flowchart of an exemplary method of using an exemplary spine-supporting pad or bathmat with an exemplary adjustable audio-visual device mount. As shown in FIG. 11, an exemplary method 200 of providing spinal support, audio, and video to a baby includes placing the exemplary pad and/or mat portion 110 on a flat surface like a countertop sink or the like, at step 202.

Next, at step 204, the exemplary method 200 includes placing a baby (or small child) on the mat portion 110. In some exemplary arrangements, the specifically shaped pad and/or mat portion 110 may be comprised of a compliant polyurethane foam with indents and grooves to adequately support a baby's neck and provide enough support to maintain proper spinal alignment of the baby. Of course, these method steps and operations are merely exemplary, and in other embodiments, other method steps and operations may be used.

Next, at step 206, the exemplary method 200 includes attaching a cincture 120 to the mat portion 110 for comfortably securing the baby to the mat portion 110.

Next, at step 208, the exemplary method 200 includes attaching a flexible arm 130 to the mat portion 110 at any of the plurality of arm receiving points 138.

Next, at step 210, the exemplary method 200 includes placing an audio-visual device in the adjustable audio-visual device mount 140 on the distal end of the flexible arm mount 130 and adjusting the platforms 142 and 144 to secure the device to provide audio and/or video to the baby, while lying on the mat portion 110. As can be appreciated, these method steps and operations are merely exemplary, and in other embodiments, other method steps and operations may be used.

FIGS. 12A to 12D are right-perspective views of an exemplary alternative arrangement of an exemplary foldable spine-supporting bathmat with an exemplary adjustable audio-visual device mount. As shown in FIGS. 12A through 12D, an exemplary apparatus 300 comprises a foldable base 302, a foldable mat portion 310, a cincture (e.g., a strap) 320, a flexible arm 330, and an audio-visual device mount 340.

The exemplary apparatus 300 is substantially similar to the exemplary apparatus 100. However, the exemplary apparatus 300 is designed to be foldable for storage and/or travel. In exemplary arrangements, the exemplary base 302 comprises a first base portion 304 and a second base portion 306. The exemplary first base portion 304 and the exemplary second base portion 306 each include an upper surface 308.

In exemplary arrangements, the first base portion 304 and the second base portion 306 are in operative movable connection through at least one hinge 309. The exemplary hinge 309 is configured such that the base 302 is enabled to be moved between a base folded position and a base open position. In some exemplary arrangements, the hinge 309 may be foregone, and the exemplary first portion 304 and the exemplary second portion 306 may be operatively, movably connected through a flexible polymer or plastic.

Figure 12A:
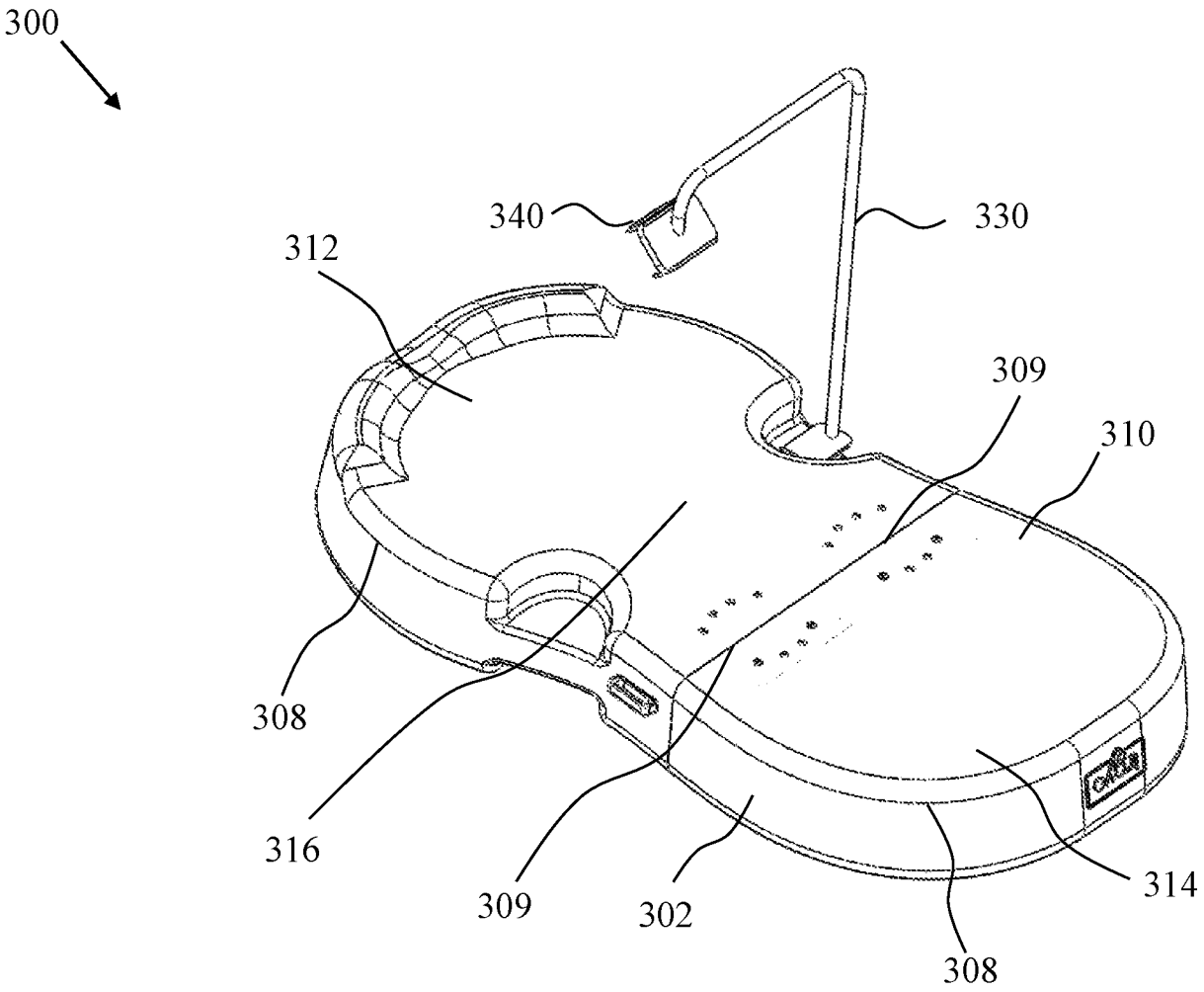
FIGS. 12A to 12D is a right-perspective view of an exemplary alternative arrangement of an exemplary foldable spine-supporting bathmat with an exemplary adjustable audio-visual device mount.
Figure 12B:
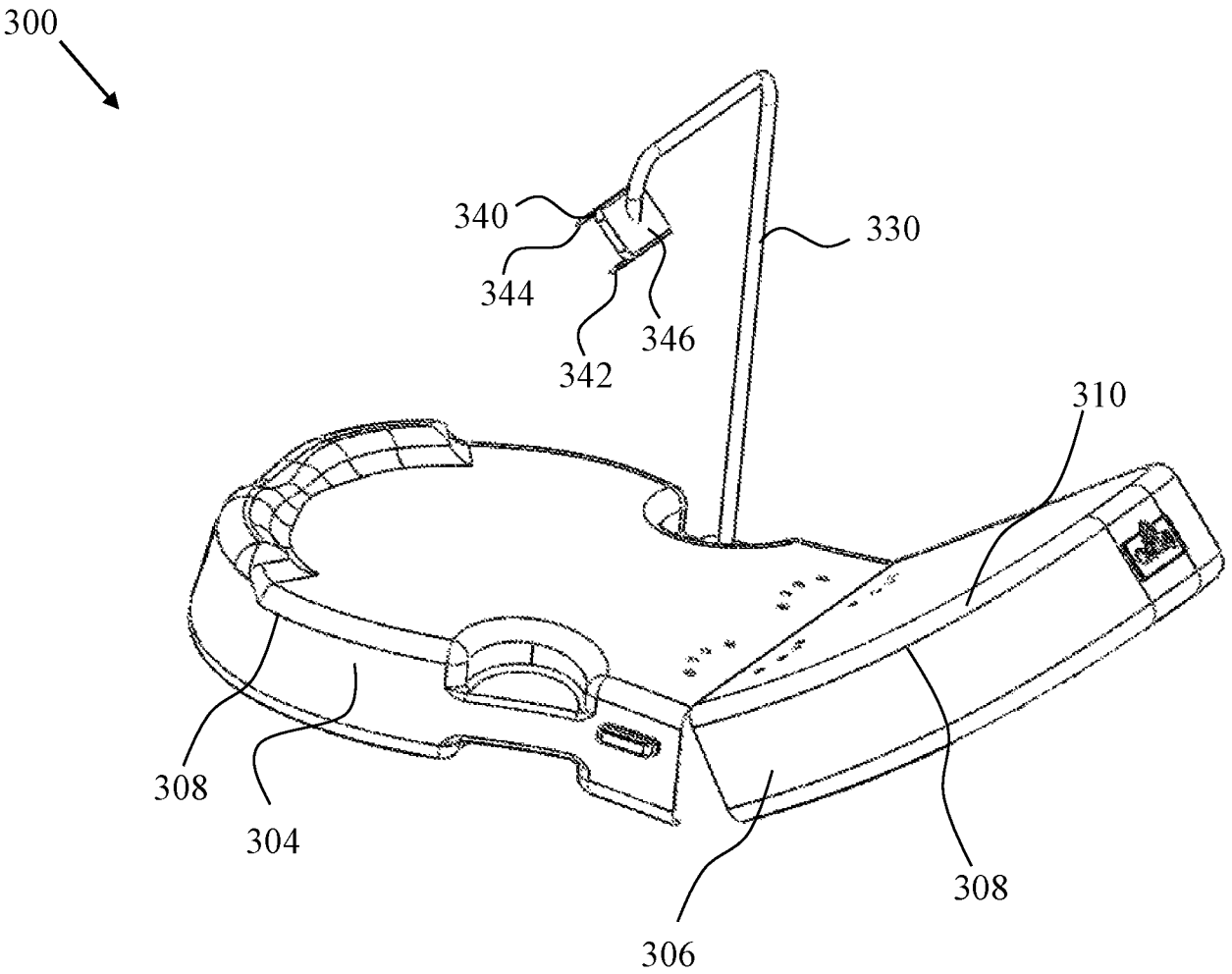
Figure 12C:
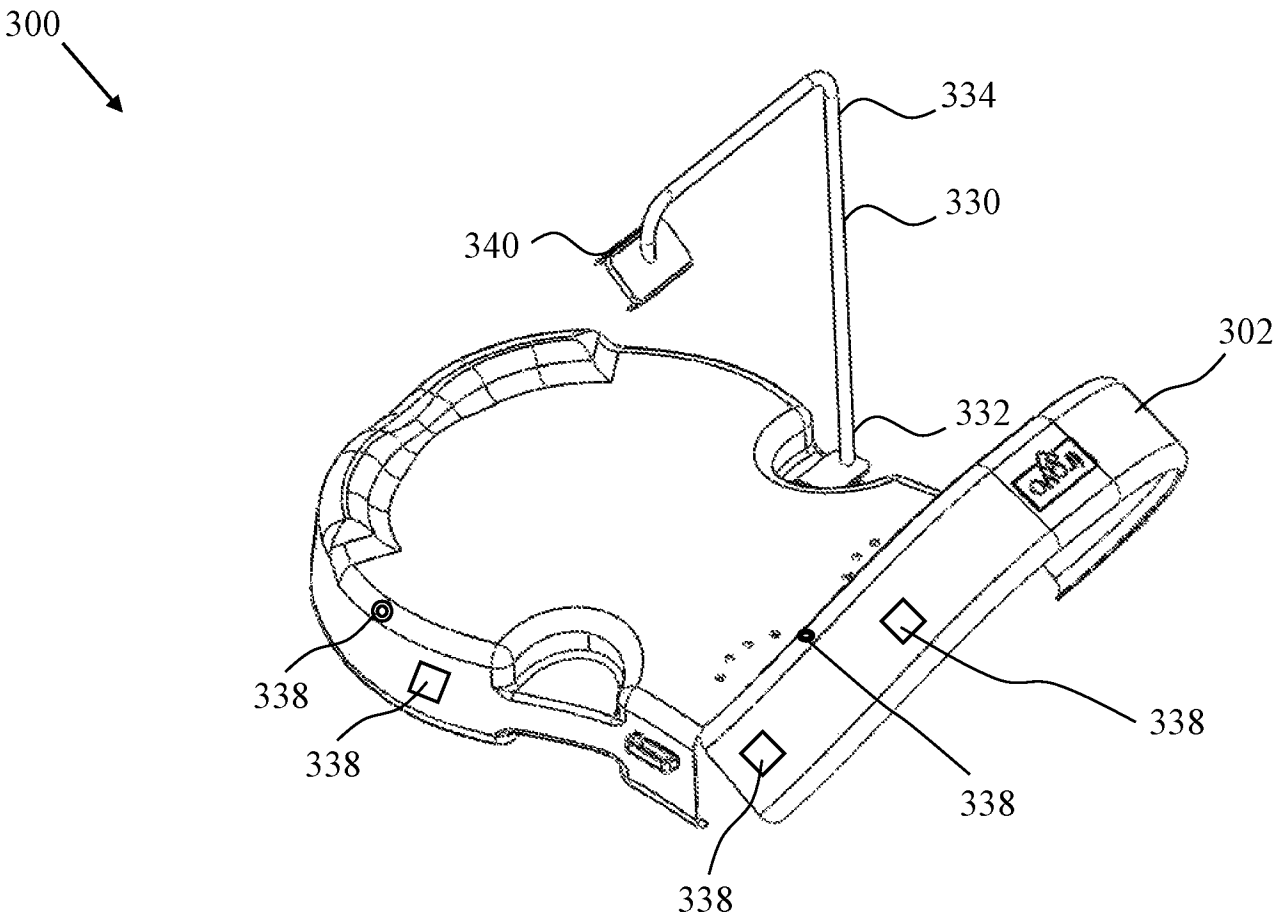
Figure 12D:
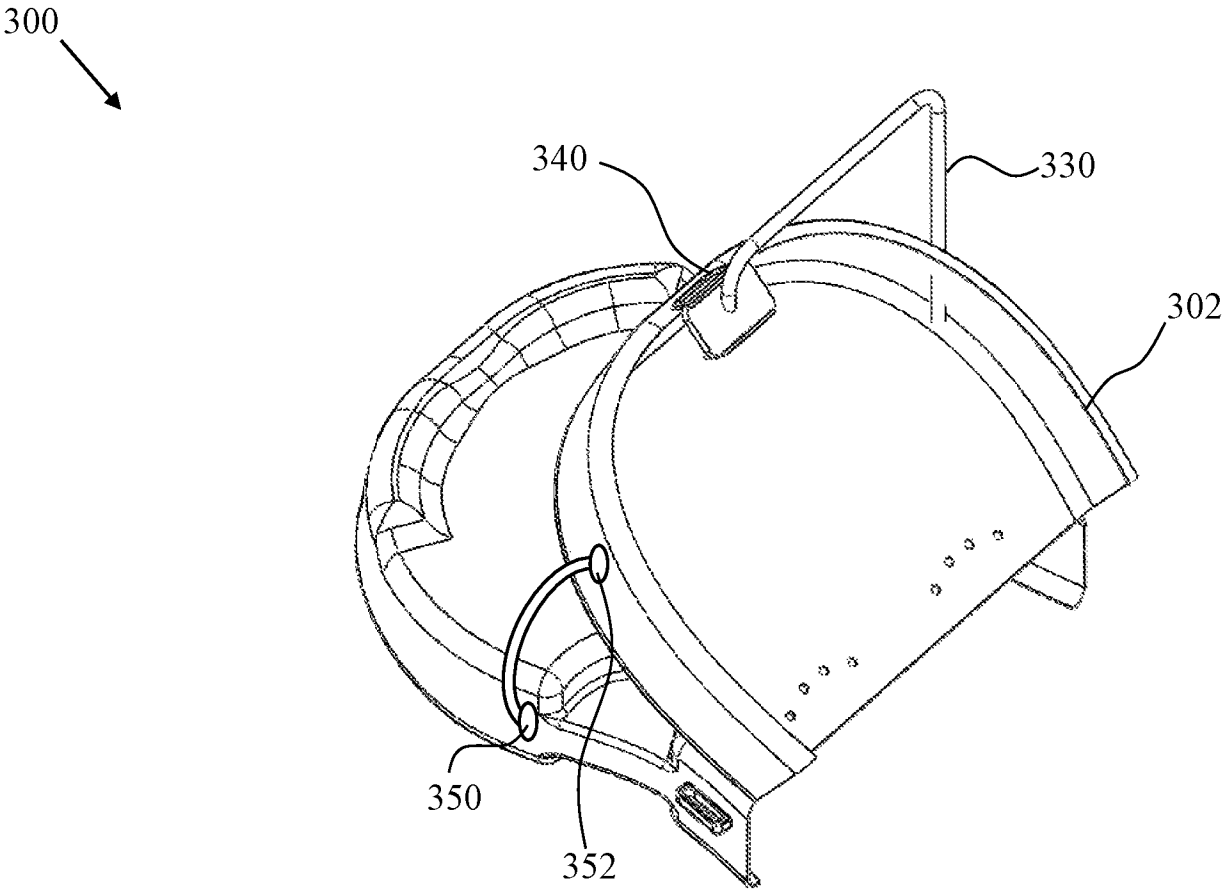

The base open position is shown in FIG. 12A, and the base closed/folded position is shown in FIG. 12D. FIGS. 12B-12C show the exemplary apparatus 300 in intermediary positions between the base open position and the base folded position.

In the base open position, as shown in FIG. 12A, the respective upper surface 308 of each of the first base portion 304 and the second base portion 306 extend continuously in a generally horizontal plane. As previously discussed, generally horizontal means plus or minus 15° from 0°. In the base open position, the mat portion 310 is in a use condition. In the use condition of mat portion 310, the mat portion 310 extends parallel to the generally horizontal plane in which the respective upper surfaces of the first base portion 304 and the second base portion 306 extend. In the base open position, the exemplary apparatus 300 is configured to receive a baby thereon for changing, showering or bathing, or sleeping.

In the base folded position, as shown in FIG. 12D, the respective upper surface 308 of each of the first base portion 304 and the second base portion 306 are in immediately adjacent, facing relation. In the base folded position, the mat portion 310 is in a folded condition disposed between the respective upper surface of the first base portion 304 and the second base portion 306. In the mat folded condition, the head portion 312 is immediately adjacent to the foot portion 314. In the base folded position, the exemplary apparatus is not configured to receive a baby thereon, rather, the apparatus 300 is in a storage or travel state that is configured to take up less space than when in the base open position. Of course, this arrangement is merely exemplary, and in other embodiments, other arrangements may be used.

The exemplary apparatus 300 includes a cincture 320, similar to the cincture 120. In some exemplary arrangements, the cincture 320 comprises at least one adjustable strap 322. The exemplary strap 322 is operatively connected to opposing sides of at least one of the first base portion 304 and the second base portion 306, or the mat portion 310. In the base open position of the apparatus 300, and in the mat use condition of the mat portion 310, the at least one adjustable strap 322 extends transversely across the receiving portion 316 intermediate of the head portion 312 and the foot portion 314. The at least one adjustable strap 322 is configured to adjustably secure a baby in an operative position on the receiving portion 316 of the mat 310. As can be appreciated, this arrangement is merely exemplary, and in other embodiments, other arrangements may be used.

The exemplary apparatus 300 includes a flexible arm 330, similar to the flexible arm 130. In exemplary arrangements, the flexible arm includes a proximal end 332 and a distal end 334. The exemplary proximal end 332 is in operative connection with one of the first base portion 304 or second base portion 306. The exemplary distal end 334 is disposed from the proximal end 332. In the base open position of the apparatus 300, the exemplary distal end 334 is configured to extend above the receiving portion 316. The exemplary proximal end 332 of the at least one flexible arm is operatively engageable with a plurality of arm receiving points 338 disposed in surrounding relation of the receiving portion 316. Further, the flexible arm 330 is configured to be detachable from any of the arm receiving points 338 and to be moved into another position in engagement with another of the plurality of arm receiving points 338. When the flexible arm 330 is in engagement with an arm receiving point 338, the distal end 334 of the flexible arm 330 is operatively positioned above the receiving portion 316 for viewing of an audiovisual device in engagement with a mount 340. The exemplary arm receiving points 338 may comprise any of the arm receiving structures and mechanisms discussed herein.

The exemplary apparatus 300 further includes an adjustable device mount 340, similar to the adjustable device mount 140. The exemplary adjustable device mount 340 is in operative connection with the distal end 334 of the flexible arm 330. The exemplary adjustable device mount 340 is configured to operatively releasably engage any of the audiovisual devices discussed herein. In exemplary arrangements, the exemplary device mount 340 includes a bottom platform 342, a top platform 344, a backing 346, and elongated projections 348 which all function in a similar manner as discussed in connection with the adjustable device mount 140. Of course, this arrangement is merely exemplary, and in other embodiments, other arrangements may be used.

As shown in FIG. 12D, in alternative exemplary arrangements, the exemplary first base portion 304 and the exemplary second base portion 306 each include a respective clasp piece 350 and 352. The exemplary clasp pieces 350 and 352 are operatively attached to their respective base portions. The exemplary clasp pieces 350 and 352 are configured to be engageable via a strap, or other mechanism, to maintain the exemplary apparatus 300 in the folded position for storage or travel. Of course, this arrangement is merely exemplary, and in other embodiments, other arrangements may be used.

Thus, the elements, features and relationships, and characteristics of the arrangements described achieve desirable results, eliminate difficulties encountered in the use of prior devices, methods, and systems, solve problems, and attain one or more useful objectives as stated above.

In the foregoing description, certain terms have been used for brevity, clarity, and understanding. However, no unnecessary limitations are to be implied therefrom because such terms are used for descriptive purposes and are intended to be broadly construed. Moreover, the descriptions and illustrations given herein are by way of example, and the useful features are not limited to the exact details shown and described.

Further, the descriptions which refer to left or right, top or bottom, or similar terms indicating relative locations of items shall not be deemed limiting, and it will be understood that exemplary arrangements can be configured and used in different orientations.

In addition, it should be understood that the various exemplary arrangements and their features and relationships may be combined, interchanged, and otherwise used together to produce further alternative exemplary arrangements not discussed herein. However, the scope of the disclosure covers such alternative arrangements of the features and relationships as well.

Having described the features, discoveries, and principles of the exemplary arrangements, the manner in which they are constructed, operated, and utilized, and the advantages and useful results obtained, the new and useful structures, devices, elements, arrangements, parts, combinations, systems, equipment, operations, methods, processes and relationships are set forth in the appended claims.

While the present general inventive concept has been illustrated by description of several example embodiments, and while the illustrative embodiments have been described in detail, it is not the intention of the applicant to restrict or in any way limit the scope of the general inventive concept to such descriptions and illustrations. Instead, the descriptions, drawings, and claims herein are to be regarded as illustrative in nature, and not as restrictive, and additional embodiments will readily appear to those skilled in the art upon reading the above description and drawings. Additional modifications will readily appear to those skilled in the art. Accordingly, departures may be made from such details without departing from the spirit or scope of applicant's general inventive concept.

What is claimed is:

1. An apparatus for baby care, comprising;

a base, wherein the base extends generally horizontally and includes an upper surface, a mat portion, wherein the mat portion is operatively connected to the base upper surface, extends generally horizontally, parallel to the base, and includes a head portion, a foot portion, and an upper receiving portion, wherein the upper receiving portion extends intermediate of the head portion and the foot portion and is configured to receive a baby thereon, at least one adjustable strap having a first strap end operatively connected to at least one of the base and the mat portion, and a flexible arm, wherein the flexible arm includes a proximal end and a distal end, wherein the proximal end is in operative connection with the base, and wherein the distal end is disposed from the proximal end and extends above the receiving portion, an adjustable device mount, wherein the adjustable device mount is in operative connection with the distal end of the flexible arm and is configured to operatively releasably engage an audio-visual device.

2. The apparatus according to claim 1, wherein the at least one adjustable strap includes an adjustable fastener, wherein the adjustable fastener is operatively configured to adjust a size of the strap to comfortably secure a baby on the receiving portion.

3. The apparatus according to claim 2, wherein the at least one strap comprises a plurality of straps, wherein the respective first strap end of each of the plurality of straps is operatively connected to at least one of the base and the mat, and wherein the respective second strap end of each of the plurality of straps is operatively connected to the opposing side of the one of the base and mat portion such that each of the plurality of straps extends transversely across the receiving portion.

4. The apparatus according to claim 3, wherein the base includes a plurality of arm receiving points disposed in surrounding relation of the receiving portion, wherein the proximal end of the flexible arm is operatively configured to be detachable from the base, and wherein the proximal end of the flexible arm is operatively engageable with each of the arm receiving points to maintain the distal end disposed above the receiving portion.

5. The apparatus according to claim 4, wherein the mat portion is comprised of a material, wherein the material is deformable.

6. The apparatus according to claim 5, wherein the mat portion comprises an oblong shape having a width that comfortably accommodates a baby.

7. The apparatus according to claim 6, wherein at least one of the mat portion and the base includes a head rest, whereby when a baby is operatively positioned on the receiving portion, a head of the baby is propped upward to view an audio-visual device engaged with the adjustable device mount.

8. The apparatus according to claim 7, wherein the adjustable fastener comprises one of a buckle, a clasp, a portion of hook and a portion of loop, and a plurality of disposed pairs of magnets.

9. The apparatus according to claim 8, wherein the at least one strap and the adjustable fastener include padding in operative connection therewith, wherein the padding is configured to protect the skin of the baby when the strap is adjusted to secure the baby on the receiving portion.

10. The apparatus according to claim 9, wherein the base comprises a first portion and a second portion, wherein the first portion and the second portion each include a portion of the base upper surface and are operatively movably connected by at least one hinge, wherein the base is movable between a folded position and an open position, wherein in the folded position, the respective upper surface of each of the first portion and the second portion are in facing relation, and wherein in the open position, the respective upper surface of each of the first portion and the second portion extend continuously in a generally horizontal plane.

11. The apparatus according to claim 10, wherein in the base folded position, the mat portion is in a folded condition disposed between the respective upper surface of the first portion and the second portion, wherein in the mat folded condition, the head portion is immediately adjacent to the foot portion.

12. The apparatus according to claim 11, wherein in the base open position, the mat portion is in a use condition, wherein in the mat use condition, the mat portion extends parallel to the generally horizontal plane in which the respective upper surface of the first and second portions extends.

13. The apparatus according to claim 12, wherein each of the plurality of arm receiving points comprises one of an arm receiving aperture, an arm receiving slot, and a first magnet operatively connected to the flexible arm and a second magnet operatively connected to the base.

14. The apparatus according to claim 4, wherein the material of the mat portion comprises a polyurethane foam, wherein the polyurethane foam includes a plurality of disposed indents and grooves, wherein the indents and grooves are configured to support a neck of the baby and to provide support to maintain proper spinal alignment of the baby.

15. An apparatus for baby care, comprising:

a base, wherein the base comprises a first portion and a second portion, wherein the first portion and the second portion are operatively movably connected by at least one hinge, wherein each of the first portion and the second portion include a respective upper surface, a deformable mat portion, wherein the deformable mat portion is operatively connected to at least one of the first base portion and the second base portion and extends across the upper surfaces thereof, and includes a head portion, a foot portion, and an upper receiving portion, wherein the upper receiving portion extends intermediate of the head portion and the foot portion and is configured to receive a baby thereon, wherein the base is movable between a folded position and an open position, wherein in the base folded position, the respective upper surface of each of the first portion and the second portion are in facing relation, and the mat portion is in a folded condition disposed between the upper surfaces of the first and second portion, and wherein in the mat folded condition the head portion is immediately adjacent the foot portion, wherein in the base open position, the respective upper surface of each of the first portion and the second portion extend continuously in a generally horizontal plane, and the mat portion is in a use condition, wherein in the use condition, the mat portion extends parallel to the generally horizontal plane in which the respective upper surfaces of the first and second portions extend, at least one adjustable strap, wherein the at least one adjustable strap is operatively connected to opposing sides of at least one of the first or second base portions, and wherein in the base open position and the mat use condition, the at least one adjustable strap extends transversely across the receiving portion intermediate of the head portion and the foot portion, and is configured to adjustably secure a baby in an operative position on the receiving portion, a flexible arm, wherein the flexible arm includes a proximal end and a distal end, wherein the proximal end is in operative connection with one of the first or second base portions, and wherein the distal end is disposed from the proximal end, wherein in the base open position, the distal end extends above the receiving portion, an adjustable device mount, wherein the adjustable device is in operative connection with the distal end of the flexible arm, and is configured to operatively releasably engage an audio-visual device.

16. The apparatus according to claim 15, wherein in the base folded position, the flexible arm is configured to be manipulated to extend between the respective upper surfaces of the first and second portions.

17. The apparatus according to claim 16, wherein the base includes at least one clasp, wherein the at least one clasp includes a first clasp piece operatively attached to the first base portion and a second clasp piece operatively attached to the second base portion, wherein the first and second clasp pieces are operatively engageable to maintain the base in the folded position.

18. The apparatus according to claim 17, wherein the at least one strap includes an adjustable fastener, wherein the adjustable fastener is operatively configured to adjust a size of the strap to comfortably secure a baby on the receiving portion.

19. The apparatus according to claim 18, wherein the base includes a plurality of arm receiving points disposed in surrounding relation of the receiving portion, wherein the proximal end of the flexible arm is configured to be detachable from the base, and wherein the proximal end of the flexible arm is operatively engageable with each of the arm receiving points to maintain the distal end disposed above the receiving portion.

20. An apparatus for baby care, comprising:

a base, wherein the base comprises a first portion and a second portion, wherein the first portion and the second portion are operatively movably connected, wherein each of the first portion and the second portion include a respective upper surface, wherein the respective upper surfaces each include a deformable mat portion, wherein the respective deformable mat portion of each of the first and second portion together comprise a receiving portion, wherein the receiving portion is configured to receive a baby thereon, wherein the base is movable between a folded position and an open position, wherein in the base folded position, the respective upper surface of each of the first portion and the second portion are in adjacent facing relation, and the respective mat portion of each of the first portion and the second portion is disposed between the respective upper surfaces of the first and second portion, wherein in the base open position, the respective upper surface of each of the first portion and the second portion extend continuously in a generally horizontal plane, and the respective mat portion of each of the first and second portion extends parallel to the generally horizontal plane in which the respective upper surfaces extend, at least one adjustable strap, wherein the at least one adjustable strap is operatively connected to opposing sides of the base, extends transversely across the receiving portion, and is configured to adjustably secure a baby in an operative position on the receiving portion, a flexible arm, wherein the flexible arm includes a proximal end and a distal end, wherein the proximal end is in operative connection with the base, and wherein the distal end is disposed from the proximal end and is configured to extend above the receiving portion when the base is in the open position, an adjustable device mount, wherein the adjustable device is in operative connection with the flexible arm and is configured to operatively releasably engage an audio-visual device.

* * * * *